United States Patent [19]

Etchell et al.

[11] 4,337,700

[45] Jul. 6, 1982

[54] BLANKET CYLINDER CONSTRUCTION FOR PRINTING PRESS

[75] Inventors: Gordon Etchell, Downers Grove; Cyril W. Frank, Brookfield, both of Ill.

[73] Assignee: Pathfinder Graphic Associates, Inc., Cicero, Ill.

[21] Appl. No.: 154,540

[22] Filed: May 30, 1980

[51] Int. Cl.[3] ..... B41F 1/28

[52] U.S. Cl. ..... 101/415.1

[58] Field of Search ..... 101/415.1, 378, 148

[56] References Cited

U.S. PATENT DOCUMENTS

| | | | |
|---|---|---|---|
| 1,927,728 | 12/1933 | Wolff | 101/415.1 |
| 2,121,309 | 6/1938 | Wale | 101/415.1 |
| 2,204,928 | 6/1940 | Culver | 101/415.1 |
| 2,820,409 | 1/1958 | Johnson | 101/415.1 |
| 3,495,531 | 2/1970 | Thatchee | 101/148 |
| 3,633,246 | 1/1972 | Kirkpatrick | 101/415.1 |
| 3,885,486 | 5/1975 | Kirkpatrick et al. | 101/415.1 |
| 4,122,774 | 10/1978 | Sauer | 101/415.1 |

FOREIGN PATENT DOCUMENTS

| | | | |
|---|---|---|---|
| 289633 | 8/1914 | Fed. Rep. of Germany | 101/378 |

*Primary Examiner*—Clifford D. Crowder
*Assistant Examiner*—David J. Isabella
*Attorney, Agent, or Firm*—Leydig, Voit, Osann, Mayer & Holt, Ltd.

[57] ABSTRACT

A blanket cylinder having a longitudinal groove of rectangular cross section formed therein with an insert of matching "U"-shaped section dimensioned to seat in the groove. Reinforcing bars at the end of the blanket are received in the insert to extend along the inner walls thereof, the reinforcing bars presenting, along their inner edges, upwardly facing ledge surfaces. A longitudinal clamping bar dimensioned to bridge and clampingly seat upon the ledge surfaces has a series of radially oriented cap screws threaded into holes in the bottom of the groove, so that upon tightening of the cap screws the reinforcing bars are drawn downwardly to tension the blanket. The insert has integral flanges along its presented edges over which the ends of the blanket are bent at right angles, the flanges extending mutually inwardly so that a minimum gap is defined by the flanges thereby to enable use of the blanket cylinder with a plate cylinder having a maximum of printing area.

1 Claim, 6 Drawing Figures

BLANKET CYLINDER CONSTRUCTION FOR PRINTING PRESS

It is conventional in a blanket cylinder to provide a longitudinal groove for accommodating the lock-up and tensioning device for the blanket resulting in a "gap" in the surface of the blanket which serves as a limitation upon the printing area of the plate on the cooperating plate cylinder.

It is desirable for reasons of printing economy to maximize the printing area of the plate and a search has been underway for plate securing arrangement which reduces the width of the corresponding gap in the plate cylinder. One plate securing arrangement which enables the gap in the plate cylinder to be reduced to an absolute minimum is disclosed in our prior application entitled "No-Lock Printing Plate Assembly Using Flexible Plates," Ser. No. 188,935, filed Sept. 19, 1980, now U.S. Pat. No. 4,313,378 as a continuation-in-part of Ser. No. 115,101 filed Jan. 24, 1980, now abandoned.

Generally stated, it is an object to provide a blanket cylinder which is capable of taking advantage of the short gap constructions now attainable in the plate cylinder, for example, as described in our copending application, so that the plate and the blanket, working together, maximize the printed area on the sheet.

While it has been the practice to provide a blanket cylinder having a relatively wide groove which has become more or less standardized, it is an object, employing the present invention, to achieve a gap width, with maximization of printing area, which is substantially less than the width of the usual groove and which may, for example, be as little as one-half, or less, of the groove width.

It is another object to provide a blanket cylinder on which the blanket is securely and reliably held during the printing operation, even where the reinforcing bars are of limited thickness, and which is particularly distinguished by easy installation and tensioning as well as easy removal of the blanket from the cylinder.

In this connection it is an object to provide a tensioning lock-up for a blanket which includes a clamping bar dimensioned for snug reception between the bent-over ends of the blanket and which includes means for wedging apart the ends of the blanket and the attached reinforcing bars to prepare for entry therebetween of the clamping bar into seated position on the reinforcing bars.

It is another object to provide a blanket locking and tensioning arrangement in which the reinforcing bars at the ends of the blanket are snugly accommodated in an insert and in which the insert is made of relatively soft, nonferrous material having self-lubricating properties with respect to the reinforcing bars so that they are freely slidable for assembly, adjustment and removal.

It is yet another object to provide a blanket locking and tensioning arrangement including a "U"-shaped insert for a blanket cylinder which is engaged by the blanket in such a way as to keep the walls of the insert snugly positioned against the side walls of the groove, as well as against the bottom, to preserve the supportive integrity of the insert, and which is useful both in new designs of presses and, on a retrofit basis, on presses already in the field.

Other objects and advantages of the invention will become apparent upon reading the attached detailed description and upon reference to the drawings in which.

Figure 1:
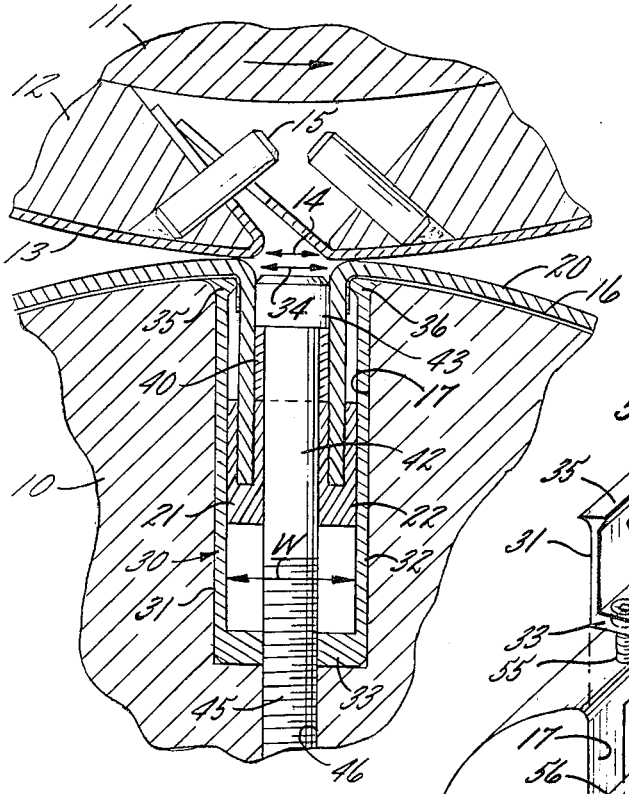
FIG. 1 is a fragmentary cross section taken through cooperating portions of a blanket and plate cylinder and illustrating the inventive structure which has been incorporated in the blanket cylinder.

While the invention has been described in connection with a preferred embodiment, it will be understood that we do not intend to be limited to the particular embodiment shown but intend, on the contrary, to cover the various alternative and equivalent constructions included within the spirit and scope of the appended claims.

Turning now to the drawings a blanket cylinder 10 cooperates with a plate cylinder 11, both of the cylinders being conventionally formed of steel and driven in synchronism by means not shown. The plate cylinder 11 has a saddle 12 which supports a printing plate 13 having a narrow non-printing gap 14 in its surface. The leading and trailing edges of the plate are engaged and registered by a pin 15 as described in the co-pending application mentioned above.

Figure 3:
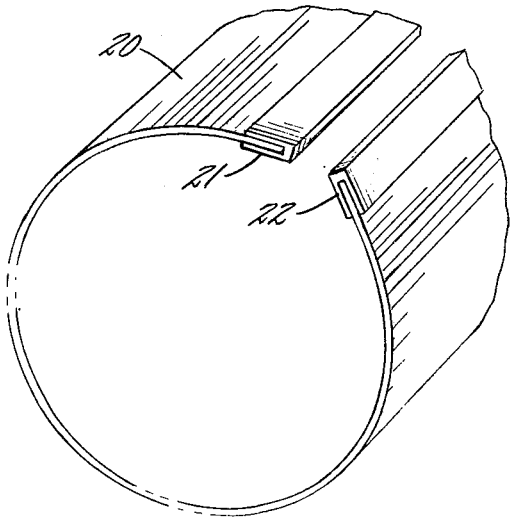
FIG. 3 is a fragmentary perspective showing the blanket and the nature of the reinforcing bars at the ends thereof.

The blanket cylinder has an outer cylindrical surface 16 which is interrupted by a longitudinal groove 17 of rectangular section and of constant width and depth. Mounted upon the blanket cylinder is a blanket 20 (see also FIG. 3) having reinforcing bars 21, 22 at its ends, the reinforcing bars being conventionally made of steel or aluminum in a "U" configuration with the end of the blanket clamped between the side walls. The side walls form ledges 21*a*, 22*a* (see also FIG. 5) enabling the bars to be clampingly engaged, as will become clear. Underlying the blanket is an optional layer of packing 23. A gap 34 exists between the bent-over ends of the blanket 20 and having a narrow width which is comparable to the width of the gap 14 in the plate cylinder.

In accordance with the present invention an insert of rectangular "U"-shaped cross section is provided, dimensioned to seat in the groove 17 flatly with respect to the bottom and side walls of the groove. The reinforcing bars at the ends of the blanket are received in the insert and extend longitudinally along the inner walls thereof so that the ledge surfaces 21*a*, 22*a* on the reinforcing bars are upwardly facing and spaced parallel to one another. A longitudinal clamping bar of rectangular cross section is provided to bridge, and seat upon, the ledge surfaces, the clamping bar being held in place by a series of radially oriented cap screws which are threaded into holes at the bottom of the groove so that upon uniform tightening of the cap screws the reinforcing bars are drawn downwardly toward the bottom of the groove for uniform tensioning of the blanket.

It is one of the features of the invention that the insert has integral flanges along its outer edges over which the ends of the blanket are bent at right angles, tending to hold the insert captive along its length against centrifugal dislodgement. The flanges extend mutually inwardly so that the gap defined by the flanges is substantially less than the width of the groove and, indeed, is less than the internal width dimension of the insert, being just large enough to accommodate the heads of the cap screws and the width of the clamping bar between the bent-over ends of the blanket to permit easy assembly and disassembly while minimizing the width of the gap. The flanges 35, 36 also extend mutually outward and overhang the walls of the groove 17, thereby seating against the rounds at the top of the groove 17.

Figure 2:
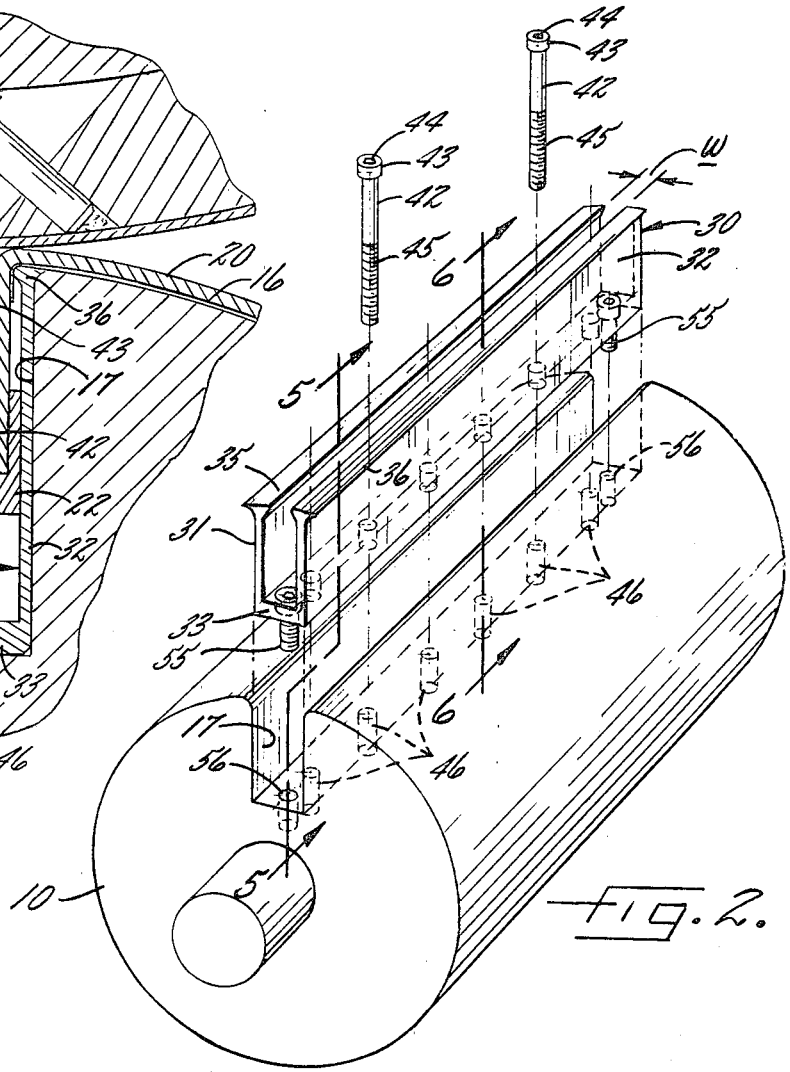
FIG. 2 is an exploded perspective showing the construction of the blanket cylinder.

The insert, indicated generally at 30, has side walls 31, 32 and a bottom wall 33. The walls 31–33 seat flatly with respect to the bottom and side walls of the groove 17. The thickness of the side walls 31, 32 is such as to produce a reduced internal width dimension W. Extending along the outer edges of the insert over which the ends of the blanket are bent at right angles are integral flanges 35, 36, respectively, the flanges extending mutually inwardly so that the width, indicated at w (FIG. 2), between the flanges is less than the internal width dimension W of the insert.

For the purpose of bridging, and clampingly seating upon, the reinforcing bars 21, 22, a clamping bar 40 is provided having a series of radially oriented holes 41 which serve as clearance holes for cap screws 42 which serve as clamping bolts, the cap screws having cylindrical heads 43 with an axial "hex" recess 44 for entry of a turning tool such as an Allen wrench. The shanks 45 of the screws are threadable into holes 46 in the bottom of the groove and which are in register with the holes 41 in the bar 40.

In carrying out the present invention the diameter of the heads on the cap screws is substantially equal to the width dimension of the clamping bar, and the width w of the space between the flanges is such that, when the blanket is stretched over the flanges, the gap in the blanket is just large enough to snugly, yet comfortably, accommodate the heads of the cap screws and the clamping bar into which the cap screws are inserted.

For the highest degree of reliability the clamping bar 40 preferably presents sharp edges at its lower corners and has a width sufficiently great as to crowd the ends of the blanket laterally away from one another thereby to hold the reinforcing bars against the walls of the insert to insure reliable engagement of the clamping bar with the reinforcing bars in spite of the fact that the ledge surfaces 21*a*, 22*a* on the reinforcing bars may be of quite narrow dimension. Stated in other words, the clamping bar holds the ends of the blanket outwardly while, at the same time, the inner walls of the insert hold the reinforcing bars inwardly to insure that such bars remain in the path of movement of, and overlapped by, the clamping bar. Reliable "purchase" is in this way achieved even where the reinforcing bars may be of relatively thin construction.

Moreover, in accordance with one of the more detailed features of the invention the projection, or overhang, of the flanges 35, 36 is approximately equal to the width of the ledge surfaces 21*a*, 22*a* on the reinforcing bars 21, 22, thereby accommodating reinforcing bars 21, 22 that wrap around the ends of the blanket 20 without an increase in the width of the gap between the flanges. The preferred embodiment employs wrap-around reinforcing bars 21, 22 which sandwich the blanket 20 between generally equal thickness of reinforcing material, thereby providing very secure attachment of the reinforcing bars 21, 22 to the blanket 20.

Figure 6:
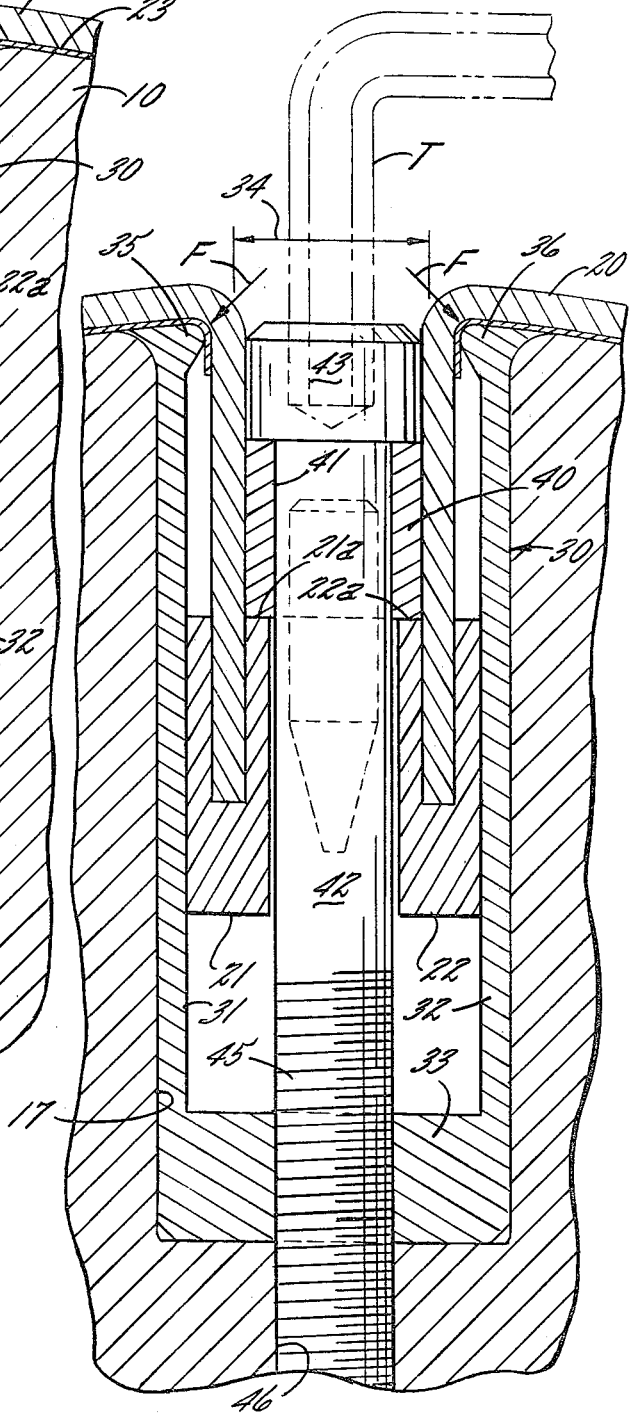
FIG. 6 is an enlarged cross section taken along line 6—6 in FIG. 2 showing the clamping bar in seated position with the clamping screws turned tight.

The result of the above is to produce a blanket lock-up and tightening assembly in which the parts are all compactly nested together in minimum width which, combined with the overhang of the flanges 35, 36 results in a minimum blanket gap 34 (FIGS. 1 and 6).

Figure 4:
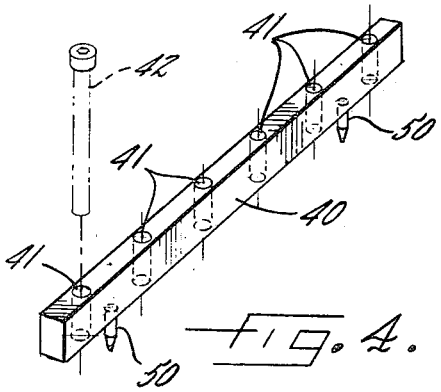
FIG. 4 is a perspective view of the clamping bar with an associated radially oriented clamping screw.
Figure 5:
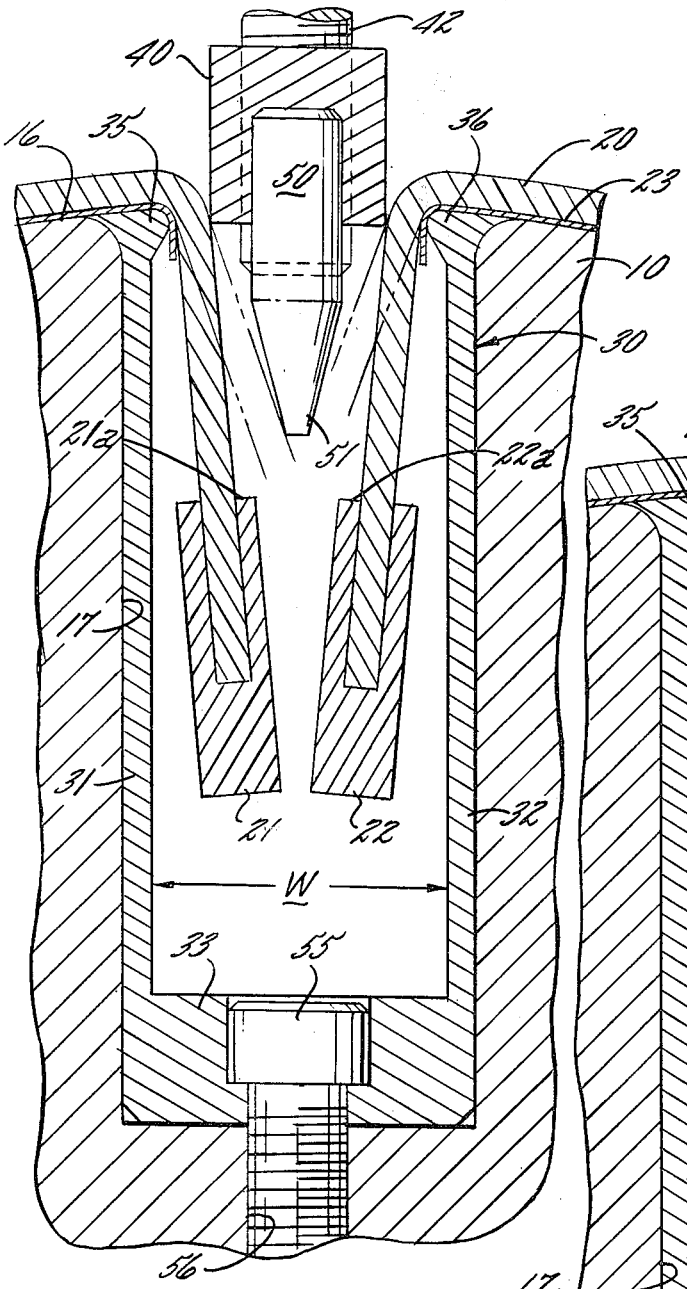
FIG. 5 is an enlarged cross section looking along line 5—5 in FIG. 2 and showing the clamping bar being inserted into the gap.

Because of the snugness of the accommodation of the clamping bar and the cap screws which penetrate it, the clamping bar has, extending radially from its underside, a plurality of wedge elements spaced between adjacent ones of the clamping screws for the purpose of wedging apart the ends of the blanket and the attached reinforcing bars to prepare for entry therebetween of the clamping bar into seated position on the reinforcing bars. As shown in FIGS. 4 and 5 the wedge elements are in the form of a pair of spaced pins 50 which are recessed in the clamping bar and which have, at the lower ends, a tapered tip 51. It will be understood that before the bent-over ends of the blanket are anchored in place they tend, because of the stiffness of the blanket material, to project toward one another along the paths which have been shown dot-dash in FIG. 5, which tends to obstruct entry of the clamping bar 40. The tapered tips 51, acting in unison, first wedge apart the opposed end surfaces of the blanket and, as such ends separate, the taper acts further to crowd between the reinforcing bars 21, 22. Because of the length, or "reach" of the tapered elements, they have a favorable mechanical advantage so that the blankets tends to bend sharply at the flanges 35, 36 with the result that the clamping bar 40 slides inwardly until the leading corner edges thereof are seated upon the ledges 21*a*, 22*a*. The cap screws may be threadedly engaged, by the fingertips, in their respective threaded openings 45 at the bottom of the groove. Following this a turning tool T, in the form of an Allen wrench or the like (FIG. 6), may be inserted successively into the heads of the cap screws to draw the reinforcing bars 21, 22 downwardly toward the bottom of the groove for uniform tensioning of the blanket.

Notwithstanding the snug clearance of the clamping bar 40 and screw heads 43 in the blanket gap 34, it will be understood that the width w between the flanges is, nonetheless, sufficient to produce what may be termed a "comfortable" fit, that is, a fit such that the clamping bar and cap screws slide freely into place, and are just as freely removed.

It is preferred to make the insert 30 of a continuous aluminum extrusion. Alternatively, other non-ferrous material, softer than the steel of the cylinder or the metal of the reinforcing bars, may be employed, particularly a durable and dimensionally stable plastic material such as Delrin. The result in either event is to provide a self-lubricating effect upon the reinforcing bars thereby precluding stickiness or binding against the inner wall of the insert as the cap screws are screwed inwardly or outwardly.

It is one of the features of the present construction that the insert, in spite of its relative softness, and in spite of the centrifugal forces to which it is subjected, need not be secured either continuously or at closely spaced intervals in the bottom of the groove. This is because the blanket, as it is tightened, in being drawn around the edges of the flanges 35, 36, provides a strong, downward component of retaining force which is distributed uniformly along the insert preventing any possibility of unseating during rotation. However, to maintain the insert captive in the groove in the absence of a blanket, auxiliary cap screws are provided, preferably at the remote ends of the insert, as indicated at 55 (FIGS. 2 and 5) extending through clearance openings in the bottom of the insert and screwed into threaded holes 56 in the bottom of the grooves.

The reaction forces against the flanges 35, 36 and indicated at F in FIG. 6, are not only substantially equal but are directed symmetrically against the flanges at angles of approximately 45 degrees as shown. This, in addition to keeping the insert bottomed in the groove, keeps the side walls of the insert flatly against the side walls of the groove and the outwardly overhanging part of the flanges 35, 36 seated against the rounds at the top of the groove 17. Moreover, the side walls of the groove are prevented from bowing inwardly, and thus inviting failure by column action, by the presence of the reinforcing bars 21, 22. The net result is to preserve the supportive integrity of the insert even in the face of a highly tensioned blanket.

It will be apparent that the present device amply satisfies the objects set forth above. The blanket gap is, by use of the invention, reduced to approximately half of the normal dimension, an amount which is compatible with the minimum gap achievable in the press cylinder. The blanket is securely and reliably held during the printing operation, even at high press speed. The arrangement is easily assembled, conveniently adjustable, and readily disassembled when replacement of the blanket becomes necessary. The construction is highly economical and may be employed both on new presses and on existing presses by retrofit in the field.

The term "blanket cylinder" as used herein, it will be understood, is a general term applying to any cylinder covered by a tensioned blanket, or outer covering, regardless of whether such cylinder is employed in a lithograph press or a letter press. The term "cap screw" used herein, while particularly intended to cover a machine screw having a cylindrical head with a hex recess, is not limited thereto but includes any alternative type of machine screw permitting axial insertion of a turning tool.

What we claim is:

1. In a printing press a blanket cylinder having a longitudinal groove of rectangular section and of constant width and depth formed in the surface thereof, an insert of rectangular "U"-shaped cross section dimensioned to seat in the groove flatly with respect to the bottom and side walls of the groove, a blanket having reinforcing bars secured to its ends, the reinforcing bars being received in the insert and extending longitudinally along the inner walls thereof so that the reinforcing bars present, along their inwardly facing sides, upwardly facing ledge surfaces spaced parallel to one another, a longitudinal clamping bar dimensioned to bridge and clampingly seat upon the ledge surfaces and a series of radially oriented cap screws spaced along the length of the groove, the cap screws penetrating the clamping bar and insert and threaded into holes at the bottom of the groove so that upon uniform tightening of the cap screws the reinforcing bars are drawn downwardly toward the bottom of the groove thereby uniformly tensioning the blanket, the clamping bar having, extending radially from its underside, a plurality of wedge elements spaced between adjacent ones of the clamping screws for the purpose of wedging apart the ends of the blanket and the attached reinforcing bars to prepare for entry therebetween of the clamping bar into seated position on the reinforcing bars, the insert having integral flanges along its outer edges over which the ends of the blanket are bent at right angles tending to hold the insert captive along its length against centrifugal dislodgement, the flanges extending mutually inwardly so that the gap defined by the flanges is less than the internal width dimension of the insert and just large enough to comfortably accommodate the heads of the cap screws between the bent-over ends of the blanket thereby to enable use of the blanket cylinder with a plate cylinder having a narrow gap and a maximum of printing area.

* * * * *